United States Patent [19]

Tsukamoto et al.

[11] Patent Number: 4,756,452

[45] Date of Patent: Jul. 12, 1988

[54] MOLTEN METAL POURING NOZZLE

[75] Inventors: Noboru Tsukamoto; Masaru Terao, both of Akaiwa; Hiroyasu Uiji, Bizen, all of Japan

[73] Assignee: Shinagawa Refractories Co., Ltd., Tokyo, Japan

[21] Appl. No.: 112,809

[22] Filed: Oct. 23, 1987

[30] Foreign Application Priority Data

Nov. 13, 1986 [JP] Japan ..... 61-174620[U]
Jun. 16, 1987 [JP] Japan ..... 62-92355[U]

[51] Int. Cl.[4] ..... B22D 37/00

[52] U.S. Cl. ..... 222/603; 266/220; 266/236

[58] Field of Search ..... 222/603; 266/220, 236

[56] References Cited

U.S. PATENT DOCUMENTS

| | | | |
|---|---|---|---|
| 3,651,825 | 3/1972 | Sury | 222/603 |
| 3,651,998 | 3/1972 | Rocher | 222/603 |
| 3,773,226 | 11/1973 | Kutzer | 266/220 |
| 3,838,798 | 10/1974 | Voss | 222/603 |
| 4,108,339 | 8/1978 | Lunde | 222/603 |
| 4,360,190 | 11/1982 | Ato | 222/603 |
| 4,421,257 | 12/1983 | Thrower | 222/603 |
| 4,583,721 | 4/1986 | Arakawa et al. | 222/603 |
| 4,660,808 | 4/1987 | Daussan et al. | 222/236 |
| 4,708,327 | 11/1987 | Waltenspühl | 222/603 |

FOREIGN PATENT DOCUMENTS

| | | | |
|---|---|---|---|
| 20938 | 7/1979 | Japan | 222/603 |
| 56150 | 4/1985 | Japan . | |

*Primary Examiner*—L. Dewayne Rutledge
*Assistant Examiner*—Robert L. McDowell
*Attorney, Agent, or Firm*—Frank J. Jordan; C. Bruce Hamburg; Manabu Kanesaka

[57] ABSTRACT

Disclosed herein is a porous nozzle which is made up of an upper porous brick, a dense brick, and a lower porous brick arranged vertically in layer and a casing surrounding them. The casing is provided with an inert gas supply pipe which leads to the peripheral space of the upper porous brick. The casing is also provided with another inert gas supply pipe which leads to the peripheral space of the lower porous brick.

Disclosed also herein is another porous nozzle which is made up of an upper porous brick, a dense brick, and a lower porous brick arranged vertically in layer and a casing surrounding them. The casing is provided with an inert gas supply pipe which leads to the peripheral space of the lower porous brick which communicates with the peripheral space of the upper porous brick.

12 Claims, 6 Drawing Sheets

MOLTEN METAL POURING NOZZLE

FIELD OF THE INVENTION AND RELATED ART STATEMENT

The present invention relates to a nozzle through which molten metal such as molten steel is poured. More particularly, it is concerned with a nozzle designed such that an inert gas such as nitrogen and argon is blown out from the inner surface thereof.

The tundish of the type in which the flow rate of molten metal is controlled by means of the slide valve is provided with the upper nozzle (or insert nozzle). The upper nozzle is designed such that an inert gas such as nitrogen and argon is blown out from its inner surface in order that it does not permit molten metal to solidify in it during pouring and it is not clogged with alumina-derived impurities. This type of nozzle is called a porous nozzle because it is constructed of porous refractory.

There is a porous nozzle of the known type in which porous bricks are enclosed in a steel plate casing in such a manner that a space is left between the porous bricks and the casing, and the casing is provided with an inert gas supply pipe.

There is a porous nozzle of the other known type in which the porous bricks have small openings communicating with the inert gas supply pipe passing through the steel plate casing.

There is another type of porous nozzle disclosed in Japanese Utility Model Laid-open No. 56150/1985. In this porous nozzle, the porous bricks are surrounded by a steel plate casing in such a manner that a space is left between the bottom of the porous bricks and the bottom of the casing, with the space communicating with an inert gas supply pipe connected to the casing. The porous bricks have a circular groove formed on their upper peripheral surface and vertical grooves formed on their outer surface. The upper circular groove communicates with the bottom space through the vertical grooves.

The above-mentioned porous nozzles have a disadvantage in common that a less amount of inert gas is blown out at the upper part of the porous bricks than at the lower part of the porous bricks because the inert gas supply pipe is connected to the lower side of the nozzle. This uneven distribution of inert gas causes alumina-derived impurities in molten steel to stick to the upper part of the nozzle, with the result that the flow rate of molten steel decreases or, in an extreme case, the nozzle becomes clogged.

OBJECT AND SUMMARY OF THE INVENTION

It is an object of the present invention to provide a porous nozzle which blows out an inert gas almost evenly from the inner surface of the porous bricks irrespective of their position.

It is another object of the present invention to provide a porous nozzle which does not permit alumina-derived impurities to stick to its upper part. Therefore, it prevents the product from being degraded by nozzle clogging with foreign matters or by the entrance of foreign matters which have accumulated in the nozzle and then dropped off from the nozzle.

The porous nozzle pertaining to the first invention is made up of an upper porous brick, a dense brick, and a lower porous brick arranged vertically in layer and a casing surrounding them. The casing is provided with an inert gas supply pipe which leads to the peripheral space of the upper porous brick. The casing is also provided with another inert gas supply pipe which leads to the peripheral space of the lower porous brick.

The porous nozzle pertaining to the second invention is made up of an upper porous brick, a dense brick, and a lower porous brick arranged vertically in layer and a casing surrounding them. The casing is provided with an inert gas supply pipe which leads to the peripheral space of the lower porous brick which communicates with the peripheral space of the upper porous brick.

The porous nozzle of the present invention blows out a sufficient amount of inert gas from the inner surface of the upper and lower porous bricks. Therefore, the upper part of the porous nozzle is exempt from the adhesion of alumina-derived impurities, and the porous nozzle ensures the prolonged continuous operation. Moreover, the porous nozzle contributes to the production of high quality steel because it does not permit alumina-derived impurities to accumulate on the upper inside of the nozzle and hence it eliminates the possibility of impurities entering the molten steel.

The porous nozzle of the present invention is suitable for use as the upper nozzle and lower nozzle for the slide valve and the nozzle for the nozzle stopper.

DESCRIPTION OF THE PREFERRED EMBODIMENTS

The examples of the invention are described in reference to the drawings.

Figure 1:
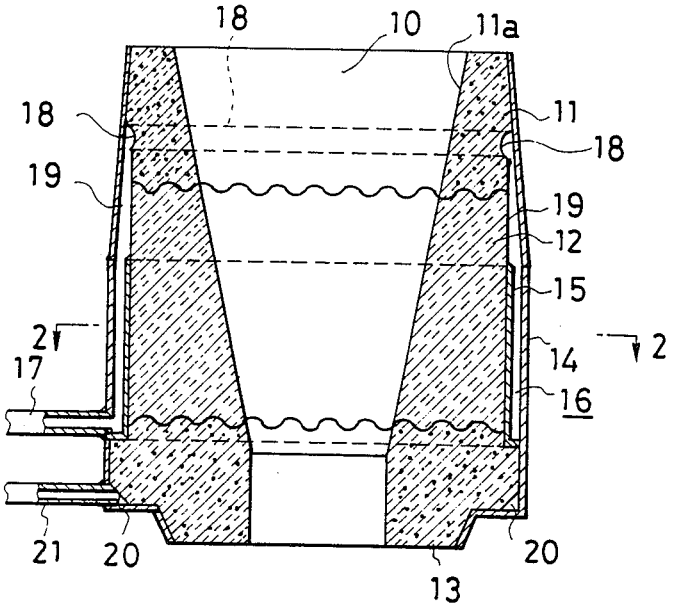
FIG. 1 is a longitudinal sectional view showing an embodiment of the nozzle pertaining to the first invention.
Figure 2:
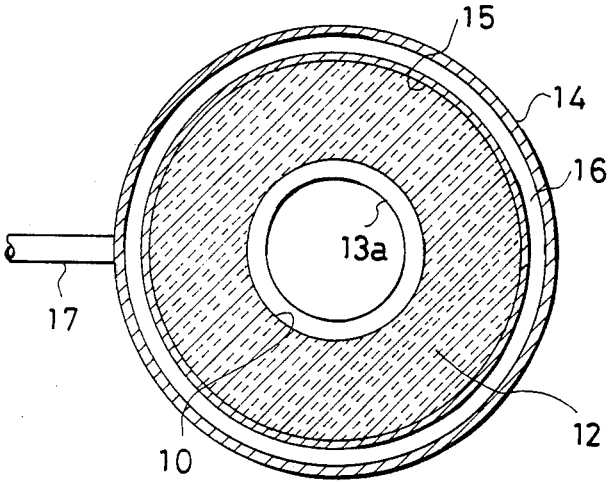
FIG. 2 is a sectional view taken in the direction of arrows along the line 2—2 in FIG. 1.

FIGS. 1 and 2 show a porous nozzle pertaining to the first invention which is intended to pour molten metal through the hole (10). The nozzle hole is formed by the upper porous brick (11) arranged at the top, the dense brick (12) arranged at the middle, and the lower porous brick (13) arranged at the bottom. These bricks (11, 12, 13) are surrounded by the steel casing (14). The casing (14) consists of a cylindrical lower section and a tapered upper section. Within the casing (14) is arranged the inner casing (15) so that the annular space (16) is formed between them. The inner casing (15) surrounds the lower half of the dense brick (12). The lower part of the inner casing (15) is welded to the inside of the casing (14). The casing (14) is provided with the first pipe (17) through which an inert gas is supplied to the annular space (16). The upper porous brick (11) has the circumferential groove (18) formed around it. This circumferential groove (18) communicates with the annular space (16) through a plurality of vertical grooves (19) formed on the external surface of the porous brick (11) and the dense brick (12). The lower porous brick (13) also has the circumferential groove (20) which is formed by cutting off its lower corner. The casing (14) is also provided with the second pipe (21) through which an inert gas is supplied to the circumferential groove (20).

In the porous nozzle constructed as shown in FIGS. 1 and 2, an inert gas entering the pipe (17) passes through the annular space (16), the vertical grooves (19), and the circumferential groove (18), and finally it blows out from the inner surface (11*a*) of the upper porous brick (11). On the other hand, an inert gas entering the pipe (21) passes through the circumferential groove (20) and blows out from the inner surface (13*a*) of the lower porous brick (13). This arrangement permits a sufficient amount of inert gas to blow out from the inner surface (11*a*) of the upper porous brick (11) and the inner surface (13*a*) of the lower porous brick (13).

Figure 3:
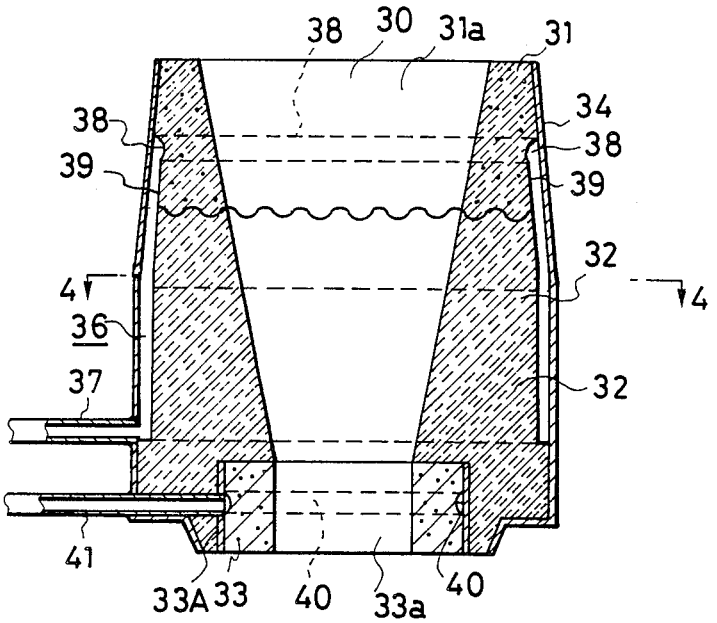
FIG. 3 is a longitudinal sectional view showing another embodiment of the nozzle pertaining to the first invention.
Figure 4:
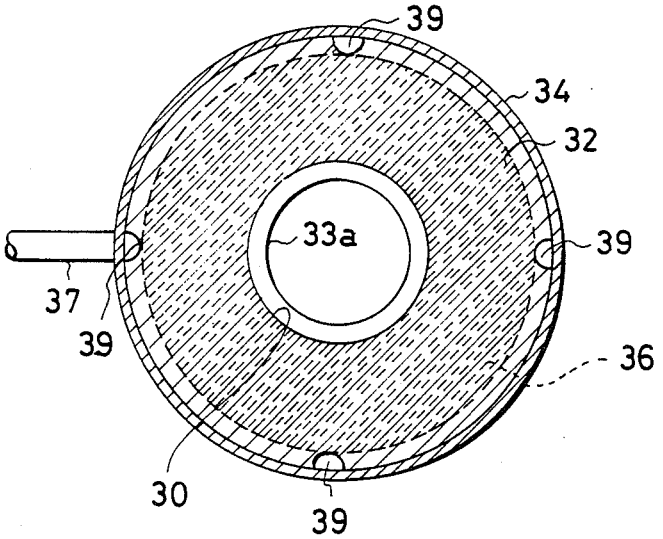
FIG. 4 is a sectional view taken in the direction of arrows along the line 4—4 in FIG. 3.

FIGS. 3 and 4 show another porous nozzle pertaining to the first invention which is intended to pour molten metal through the hole (30). The nozzle hole is formed by the upper brick (31) arranged at the top, the dense brick (32) arranged at the middle, and the lower porous brick (33) arranged at the bottom. The dense brick (32) has its peripheral part extending to the lower end of the nozzle, and the lower porous brick (33) having a smaller diameter is fitted into the lower part of the dense brick (32). The lower porous brick (33) is surrounded by the short metal cylinder (33A).

The bricks (31, 32) are surrounded by the steel casing (34). The casing (34) consists of a cylindrical lower section and a tapered upper section. The casing (34) surround the dense brick (32) in such a manner that the annular space (36) is formed between them. The casing (34) is provided with the first pipe (37) through which an inert gas is supplied to the annular space (36). The upper porous brick (31) has the circumferential groove (38) formed around it. This circumferential groove (38) communicates with the annular space (36) through a plurality of vertical grooves (39) formed on the external surface of the upper porous brick (31). The lower porous brick (33) also has the circumferential groove (40) which is formed on the curved surface. The casing (33A) is provided with the second pipe (41) through which an inert gas is supplied to the circumferential groove (40). The second pipe (41) penetrates the casing (34) and the dense brick (32).

In this embodiment, that part of the dense brick (32) facing the annular space (36) is coated with a sealant so that the inert gas does not infiltrate into the dense brick (32).

In the porous nozzle constructed as shown in FIGS. 3 and 4, an inert gas entering the pipe (37) is introduced to the upper circumferential groove (38), and an inert gas entering the pipe (41) is introduced to the lower circumferential groove (40). This arrangement permits a sufficient amount of inert gas to blow out from the inner surface (31*a*) of the upper porous brick (31) and the inner surface (33*a*) of the lower porous brick (33).

Figure 5:
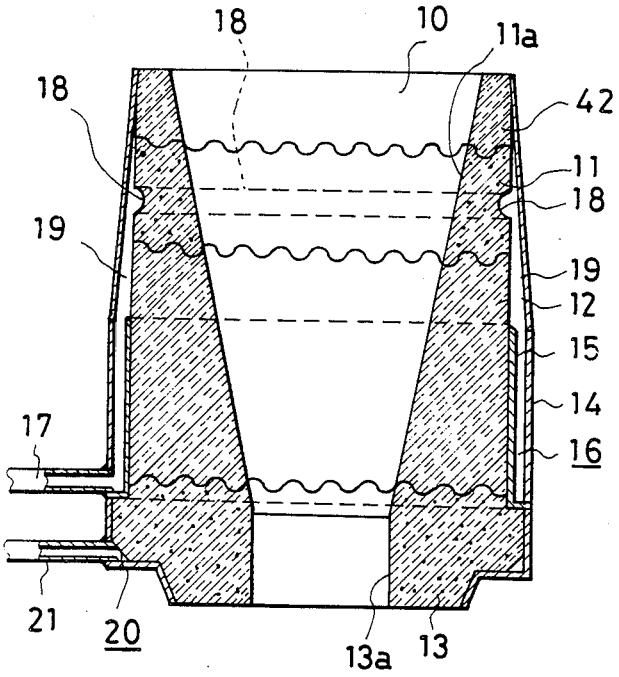
FIG. 5 is a longitudinal sectional view showing further another embodiment of the nozzle pertaining to the first invention.

FIG. 5 is a longitudinal sectional view showing another embodiment of the first invention. The porous nozzle in this embodiment has a structure similar to that of the porous nozzle shown in FIGS. 1 and 2, except that the additional dense brick (42) is placed on the upper porous brick (11). The dense brick (42) is surrounded by the casing (14). Like reference characters designate like parts in FIGS. 1 and 5.

The porous nozzle shown in FIG. 5 has an advantage over the porous nozzle shown in FIGS. 1 and 2. That is, the upper dense brick (42) having good corrosion resistance and high-temperature characteristics protects the nozzle top exposed to the highest temperature from wear. Needless to say, this concept can be applied to the porous nozzle shown in FIGS. 3 and 4. In other words, it is possible to place the dense brick (42) on the porous brick (31).

With the porous nozzle of the first invention, it is possible to separately control as desired the flow rate of inert gas to the upper porous brick (11) and the lower porous brick (13), because the inert gas is supplied through the separate pipes (17, 21).

Figure 6:
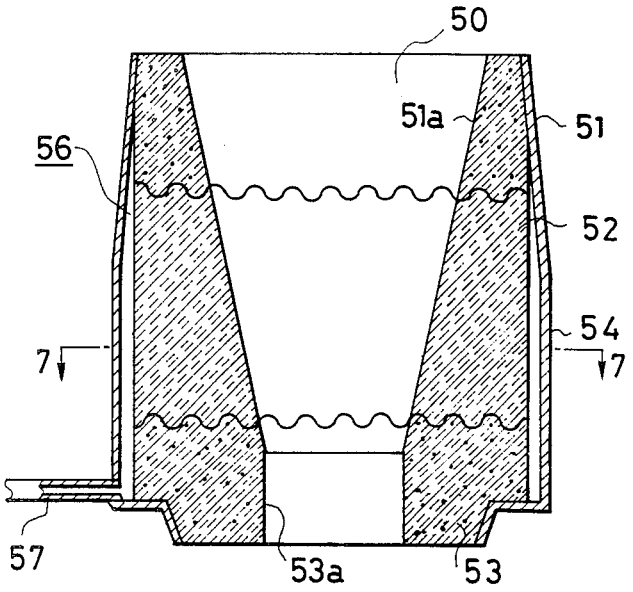
FIG. 6 is a longitudinal sectional view showing an embodiment of the nozzle pertaining to the second invention.
Figure 7:
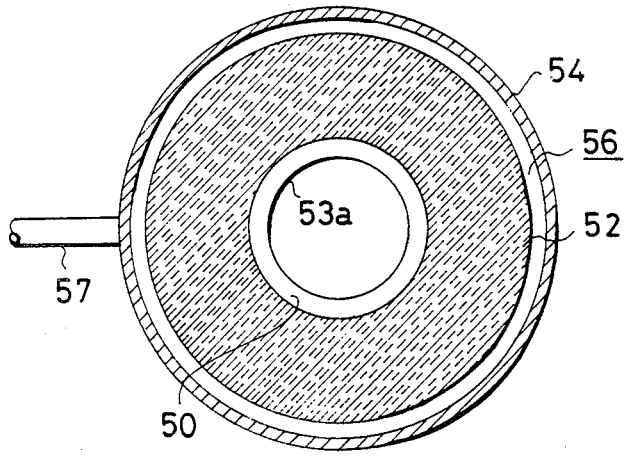
FIG. 7 is a sectional view taken in the direction of arrows along the line 7—7 in FIG. 6.

FIGS. 6 and 7 show a porous nozzle pertaining to the second invention which is intended to pour molten metal through the hole (50). The nozzle hole is formed by the upper porous brick (51) arranged at the top, the dense brick (52) arranged at the middle, and the lower porous brick (15) arranged at the bottom. These bricks (51, 52, 53) are surrounded by the steel casing (54). Between the casing (54) and the bricks (51, 52, 53) is formed the annular space (56) which extends from the middle of the peripheral surface of the upper porous brick (51) to the middle of the peripheral surface of the lower porous brick (53). The casing (54) is provided with the pipe (57) through which an inert gas is supplied to the annular space (56).

In the porous nozzle constructed as mentioned above, the inert gas entering the pipe (57) passes through the annular space (56) and blows out from the inner surface (53*a*) of the porous brick (53) and the inner surface (51*a*) of the porous brick (51). While the inert gas is passing through the inner space, it does not infiltrate into the dense brick (52) interposed between the upper porous brick (51) and the lower porous brick (53). Therefore, all the inert gas introduced into the inner space blows out through the upper and lower porous bricks (51, 53).

Figure 8:
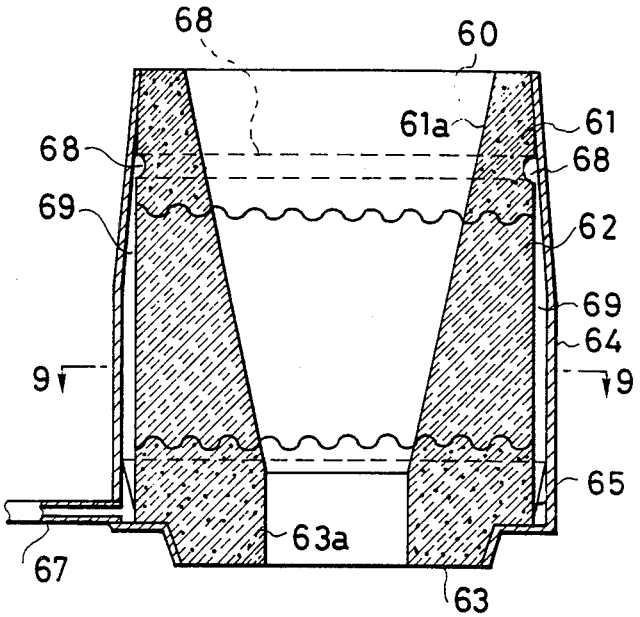
FIG. 8 is a longitudinal sectional view showing another embodiment of the nozzle pertaining to the second invention.
Figure 9:
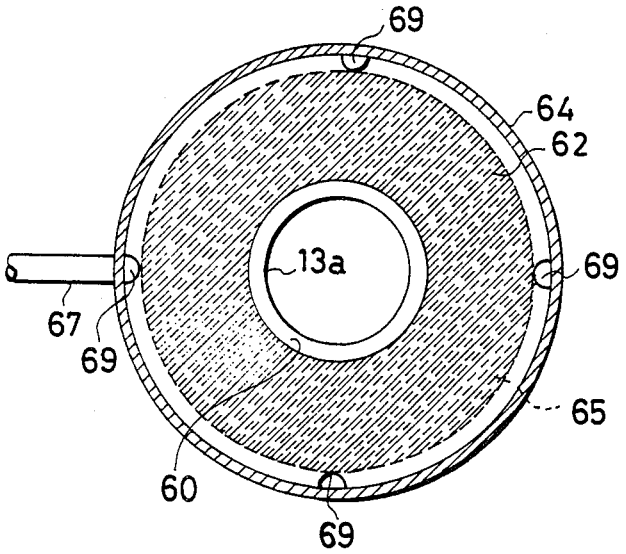
FIG. 9 is a sectional view taken in the direction of arrows along the line 9—9 in FIG. 8.

FIGS. 8 and 9 show a porous nozzle pertaining to the second invention which is intended to pour molten metal through the hole (60). The nozzle hole is formed by the upper porous brick (61) arranged at the top, the dense brick (62) arranged at the middle, and the lower porous brick (63) arranged at the bottom. These bricks are surrounded by the casing (64). The upper porous brick (61) has the circumferential groove (68) formed around it. This circumferential groove (68) communicates with the lower circumferential groove (65) through a plurality of vertical grooves (69) formed on the upper porous brick (61), the dense brick (62), and the lower porous brick (63).

The lower circumferential groove 65 is formed by cutting off the lower corner of the lower porous brick (63). The casing is provided with the pipe (67) through which an inert gas is supplied to the lower circumferential groove (65).

In the porous nozzle constructed as shown in FIGS. 8 and 9, an inert gas entering the pipe (67) passes through the lower circumferential groove (65) and blows out from the inner surface (63*a*) of the lower porous brick (63), and an inert gas entering the pipe (67) also passes through the lower circumferential groove (65), the vertical grooves (69), and the upper circumferential groove (68), and finally it blows out from the inner surface (61*a*) of the upper porous brick (61). This arrangement permits a sufficient amount of inert gas to blow out through the upper and lower porous bricks (61, 63).

Figure 10:
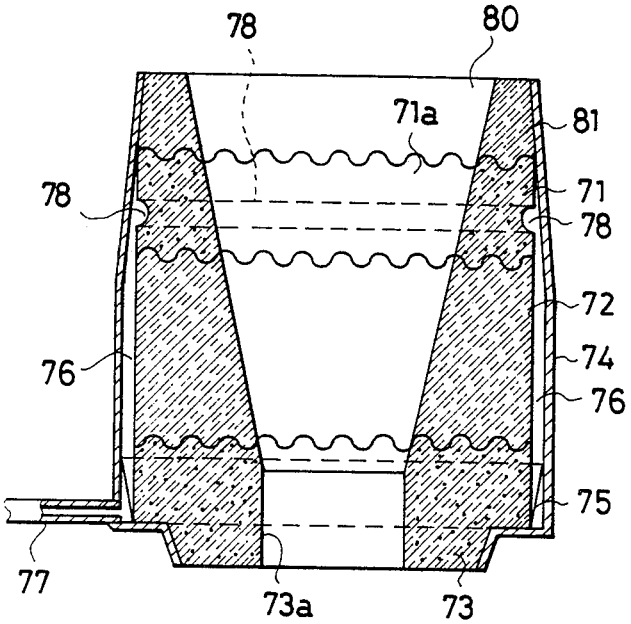
FIG. 10 is a longitudinal sectional view showing further another embodiment of the nozzle pertaining to the second invention.

FIG. 10 is a longitudinal sectional view showing another embodiment of the second invention. The porous nozzle in this embodiment has a structure similar to that of the porous nozzle shown in FIGS. 8 and 9, except that the additional dense brick (81) is placed on the upper porous brick (71). The upper dense brick (81), the upper porous brick (71), the lower dense brick (72), and the lower porous brick (73), which constitute the hole (80), are surrounded by the casing (74). The upper porous brick (71) has the upper circumferential groove (78) formed around it. The lower porous brick (73) has the circumferential grooved (75) formed around it. The circumferential grooves (75, 78) communicate with each other through a plurality of vertical grooves (76). The casing (74) is provided at its lower part with the pipe (77) through which an inert gas is supplied to the circumferential groove (75).

The porous nozzle shown in FIG. 10 has an advantage that the upper dense brick (81) having good corrosion resistance and high-temperature characteristics protects the nozzle top exposed to the highest temperature from wear. This porous nozzle permits a sufficient amount of inert gas to blow out from the respective inner surfaces (71*a*, 73*a*) of the upper and lower porous bricks (71, 73).

The upper porous brick, dense brick, and lower porous brick constituting the porous nozzle of the invention vary in thickness (length in height direction). Their thicknesses are properly selected according to the temperature and kind of the molten metal for which the nozzle is intended. For example, in the case where clogging with alumina is liable to occur at the upper part of the porous nozzle, the upper porous brick should be thicker than usual so that the amount of an inert gas which is blown out through the upper porous brick is increased accordingly.

In the case where it is necessary that an inert gas should be blown out more than usual from the lower porous brick, the lower porous brick should be thicker than usual.

With the thickness of the upper and/or lower porous bricks properly selected, a sufficient amount of inert gas can be blown out from the porous bricks according to the operating conditions of the tundish. This prevents the solidification of molten steel and the clogging of the nozzle with alumina-derived impurities. This, in turn, contributes to the improvement of steel quality and the reduction of inert gas consumption.

An additional advantage of the porous nozzle of the invention is that the upper porous brick and the lower porous brick can be properly selected from different materials according to the use conditions. For example, the upper porous brick may have larger pores and the lower porous brick may have smaller pores. In this case, larger bubbles are formed at the upper part and they float upward, and smaller bubbles are formed at the lower part and they flow downward. This is an effective means to clarify the molten steel and to prevent the nozzle clogging simultaneously.

The porous bricks and dense bricks constituting the porous nozzle of the invention may be produced from any known materials. For example, the porous bricks may be produced from high alumina, zircon, zirconia, or magnesia. They have an open-cell structure and a porosity of 15–30%, preferably 18–25%. The dense bricks is produced from high alumina, zircon, or zirconia. They have a porosity of 10–25%, preferably 12–20%.

What is claimed is:

1. A nozzle to pour molten metal which comprises a cylindrical casing with its axis positioned vertically, a first porous brick placed at the upper position in the casing, a dense brick placed at the middle or lower middle position in the casing, a second porous brick placed at the lower position in the casing, said three bricks in combination with one another forming a vertical hole through which molten metal is poured, said first porous brick having a first gas passage formed around it, said second porous brick having a second gas passage formed around it, a first gas supply pipe connected to the casing, said first gas supply pipe communicating with said first gas passage so that an inert gas introduced through the first gas supply pipe enters the first gas passage and passes through substantially the first porous brick alone and finally blows out from the inner surface of the first porous brick, and a second gas supply pipe connected to the casing, said second gas supply pipe communicating with said second gas passage so that an inert gas introduced through the second gas supply pipe enters the second gas passage and passes through substantially the second porous brick alone and finally blows out from the inner surface of the second porous brick.

2. A nozzle set forth in claim 1, wherein an additional dense brick is placed on said first porous brick.

3. A nozzle set forth in claim 1, wherein said first gas passage and said second gas passage are circumferential grooves.

4. A nozzle set forth in claim 3, wherein said first gas supply pipe is connected to the lower part of the casing and said first gas supply pipe communicates with said first gas passage through a gas passage formed along the inside of said casing.

5. A nozzle set forth in claim 1, wherein said first gas passage is an annular space formed on the periphery of the first porous brick and dense brick, and said first gas supply pipe communicates directly with the annular space.

6. A nozzle to pour molten metal which comprises a cylindrical casing with its axis positioned vertically, a first porous brick placed at the upper position in the casing, a dense brick placed at the middle or lower middle position in the casing, a second porous brick placed at the lower position in the casing, said three bricks in combination with one another forming a vertical hole through which molten metal is poured, said first porous brick having a first gas passage formed around it, said second porous brick having a second gas passage formed around it, and a gas supply pipe connected to the casing, said gas supply pipe communicating with said first gas passage and second gas passage so that an inert gas introduced through the gas supply pipe enters the first gas passage and second gas passage and finally blows out from the inner surface of said porous bricks.

7. A nozzle set forth in claim 6, wherein an additional dense brick is placed on said first porous brick.

8. A nozzle set forth in claim 6, wherein said first gas passage and said second gas passage are circumferential grooves.

9. A nozzle set forth in claim 8, wherein said gas supply pipe is connected to the lower part of the casing and said gas supply pipe communicates with said first gas passage through a gas passage formed along the inside of said casing.

10. A nozzle set forth in claim 6, wherein said first gas passage is an annular space formed on the periphery of the first porous brick and dense brick, and said gas supply pipe communicates directly with the annular space.

11. A nozzle set forth in claim 6, wherein said first porous brick differs in permeability from said second porous brick.

12. A nozzle set forth in claim 6, wherein said first porous brick has a greater pore diameter than said second porous brick.

* * * * *